US008083606B2

(12) United States Patent
Brady

(10) Patent No.: US 8,083,606 B2
(45) **Date of Patent: *Dec. 27, 2011**

(54) INTERCHANGEABLE GOLF CLUB HEADS WITH SHARED SHAFT

(75) Inventor: Patrick K. Brady, Glen Ellyn, IL (US)

(73) Assignee: Brady Management Corporation, Glen Ellyn, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/619,491

(22) Filed: Nov. 16, 2009

(65) Prior Publication Data

US 2010/0062873 A1 Mar. 11, 2010

Related U.S. Application Data

(63) Continuation of application No. 11/237,980, filed on Sep. 29, 2005, now Pat. No. 7,618,329.

(60) Provisional application No. 60/703,452, filed on Jul. 29, 2005, provisional application No. 60/613,726, filed on Sep. 29, 2004.

(51) Int. Cl.
*A63B 53/02* (2006.01)

(52) U.S. Cl. ..... 473/288; 473/307; 473/308

(58) Field of Classification Search ..... 473/288, 473/307, 298–299, 296, 308; 403/325; 279/75, 279/905

See application file for complete search history.

(56) References Cited

U.S. PATENT DOCUMENTS

| | | | |
|---|---|---|---|
| 1,613,360 | A | 1/1927 | Rigby |
| 3,516,697 | A | 6/1970 | Hahn |
| 3,848,737 | A | 11/1974 | Kenon |
| 4,664,382 | A | 5/1987 | Palmer et al. |
| 6,547,673 | B2 | 4/2003 | Roark |
| 2004/0018887 | A1 | 1/2004 | Burrows |

OTHER PUBLICATIONS

Search Report and Written Opinion, dated Dec. 5, 2006, for PCT Appl. No. PCT/US05/34683, filed Sep. 29, 2005, 13 pages.

Office action mailed Sep. 24, 2007 in U.S. Appl. No. 11/237,980 (now U.S. Pat. No. 7,618,329).

Office action mailed Feb. 21, 2008 in U.S. Appl. No. 11/237,980 (now U.S. Pat. No. 7,618,329).

Office action mailed Aug. 6, 2008 in U.S. Appl. No. 11/237,980 (now U.S. Pat. No. 7,618,329).

Office action mailed Feb. 25, 2009 in U.S. Appl. No. 11/237,980 (now U.S. Pat. No. 7,618,329).

Notice of Allowance mailed Jul. 6, 2009 in U.S. Appl. No. 11/237,980 (now U.S. Pat. No. 7,618,329).

International search report and written opinion of the International Search Authority mailed Dec. 5, 2006 in PCT App. No. PCT/US05/34683.

*Primary Examiner* — Stephen L. Blau

(74) *Attorney, Agent, or Firm* — David C. Isaacson; Fitzgerald & Isaacson, LLP

(57) ABSTRACT

A system of interchangeable club heads sharing one or more shafts and golf bag for carrying the club heads and one or more shafts. The club heads contain a shaft segment to set club length and a coupler to interconnect to the shaft and grip. The shaft contains an opposite gender coupler. The system is very lightweight and much more portable than a conventional set of golf clubs. It also creates the opportunity for players to match club heads with shafts with differing performance characteristics. Additionally, it solves a problem for golfers using long shafts on putters. These long shafts can now be disassembled for storage and transport.

10 Claims, 6 Drawing Sheets

INTERCHANGEABLE GOLF CLUB HEADS WITH SHARED SHAFT

CROSS-REFERENCE TO RELATED APPLICATIONS

The present application is a continuation of U.S. application Ser. No. 11/237,980, filed Sep. 29, 2005 now U.S. Pat. No. 7,618,329, which claims the benefit of U.S. Provisional Application Nos. 60/703,452, filed Jul. 29, 2005, and 60/613,726, filed Sep. 29, 2004, all of which are incorporated in their entirety by reference.

BACKGROUND

1. Field of the Invention

The present invention relates generally to golf club and related equipment. More specifically, the present invention relates to a golf club system having interchangeable heads that each can fit onto a single shared shaft. The present invention also relates to carrying cases for such a club system.

2. Background of the Invention

A common problem for golfers is transportation of a full set of golf clubs. Heavy and bulky sets of clubs are made heavier and bulkier by flight cases or travel bags. It is fairly common for a golfer to bring his/her own clubs because of costs of renting club sets at remote destinations. In addition to cost, among other detracting factors, the quality of such rental clubs often varies. Golfers also often develop a personal feel for, and comfort level with, their own sets of clubs, so even a high quality set of rental or demo clubs may be unsuitable depending on a specific golfer's needs and/or desires. Experienced golfers may prefer to give themselves an advantage by using their own clubs in such circumstances.

A compact club set may appeal to a wide and varied range of player groups. Even the average player may have difficulty finding adequate trunk or storage space for clubs. Some common sports cars, such as, for example the Corvette, have trunks that will not accommodate even one full-sized golf club set. As used herein, a full-sized set refers to a set of golf clubs whereby each club head is fixedly attached to its own shaft. Many smaller vehicle trunks also have trouble accommodating more than a single set.

Additionally, more senior players may have trouble lifting and/or carrying a full-sized set. Full-sized sets may also be bulky, noisy, awkward or heavy, among other negative characteristics. When such full-sized sets are placed in a hard-shell flight case the situation can become even worse. Flight cases can double the weight of a full-size set of clubs and add considerable bulk. Soft-shell cases, while they may be lighter and less bulky, still can expose the clubs to the vagaries of baggage handlers.

What is needed is a way to reduce the bulk and weight of the set while preserving the playing physics and other desirable characteristics of the clubs. The present invention allows golfers to enjoy these and other attendant advantages in a compact, easy, to use set of clubs. Beyond the benefit of increased portability, it is also possible to choose among several shafts for any one club. This may expand the game of golf to include a new dimension of performance tuning because shafts vary considerably in stiffness or spring. The present invention can allow all club heads to be matched to the best shaft for the playing situation at hand.

BRIEF SUMMARY OF THE INVENTION

A number of design alternatives were explored before arriving at the current club and head system. One area of particular concern and experimentation is the coupler for connecting the shaft to the head. Several prototypes were built in an attempt to create a coupler that would satisfy the performance requirements of the high end golfer. While many requirements exist, one overarching requirement was tightness of fit. The club heads and their male coupling pins needed to be held in contact with the coupler in the shaft without discernable wobble.

An early design utilized two floating wedges that could slide out of the way for insertion of the coupling pin and back into position to wedge the pin in place. The wedge design relied on a long cylindrical opening in the coupler and a straight cylindrical coupling pin. The fit of the device depended, in part, on the tolerance of the machining of these two components. Machining long cylindrical sections has inherent difficulties. Machine tools for cutting these components tend to dull as the cut is achieved. Such tools may dull over many cuts such as, for example, in mass-producing sets. This tool wear can be an issue for both drilled or lathed parts or any other machined parts involving a cutting tool that may wear over time. In the end, tolerances must be selected that are realistic for production. Even in prototype production quantities, parts machined to a tolerance of ±0.001 inches resulted in discernable "play" in the club with this design.

Another difficulty of this early design was the need for strong springs to force the wedges in place. Strong springs helped the wedges snap into place but made the sleeve hard to pull back with thumb and finger. The wedges also were created by multiple machining cuts which made them more expensive than desired.

The final design involved ball bearings set in a coupler body and squeezed between tracks in the coupler body and tracks in a coupler pull-back sleeve. Released tension and lateral motion of the pull-back sleeve can allow the coupling pin to be inserted. Once inserted, the release of tension on the pull-back sleeve brings force to bear on flat surfaces of the coupler pin. Finally, this force pulls a conical surface on the coupler pin into contact with a mated conical sheath surface in the coupler. These two conical surfaces can be manufactured relatively easily and inexpensively and do not suffer from the many of the machining tolerance issues of the straight cylinder design.

A deficiency of this design may be loss of friction and fit from vibration during ball and head impact. Despite a tight fit, the spring and ball/race combination may be subject to release during high vibration. A twist lock would be desirable to minimize unintentional separation. There are also a number of alternate methods of locking the coupler. The method described herein is preferred, but other locking methods would be known to those skilled in the art based upon the present disclosure.

Finally, the components of the golf system are stored in a unique bag. The small size and shape of this bag are a direct result of the design of the club system and provides an advantage to users in itself. This unique club head system makes many new bag designs possible.

According to one exemplary aspect, the present invention includes a coupler for mating a golf shaft handle to a club head comprising a first pin adapted to fit into a handle end of a golf shaft, a second pin adapted to fit into a club head end of a golf shaft, and a coupling sleeve fixedly attached to one of the first pin and the second pin, the coupling sleeve further being reversibly attachable to the other of the first pin and the second pin to allow for mating of the golf shaft handle to the club head when the coupler is in use on a golf club.

According to another exemplary aspect, the present invention includes A golf club having a detachable head comprising a first shaft segment and a second shaft segment, the first shaft segment having a grip or handle attached thereto and the second shaft segment being fixedly attached to a golf club head, and a coupler affixed to either the first shaft segment or the second shaft segment for reversibly mating the handle to the club head.

According to a further aspect, the coupler comprises an inner housing and a pull-back sleeve, whereby the pull-back is sleeve movable with respect to the inner housing to allow for movement of one or more first ball bearings within the coupler such that in a first pull-back sleeve position, the ball bearings allow insertion of an insertion pin during mating of the first and second shaft segments, and in a second pull-back sleeve position, the ball bearings hold the insertion pin axially in place to reversibly secure the first shaft segment to the second shaft segment.

According to another exemplary aspect, the present invention includes a golf bag for carrying a set of golf clubs comprising one or more shafts and a plurality of club heads that for attachment to the one or more shafts via a coupler. The golf bag comprises a compartment for holding the one or more shafts and a compartment having a plurality of fitted compartments for housing each of the plurality of club heads.

DETAILED DESCRIPTION OF THE INVENTION

Figure 1:
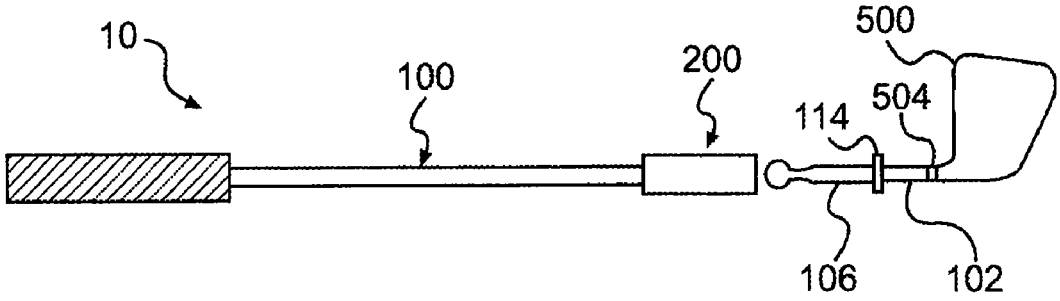
FIG. 1 shows a shaft with grip and head fitted with the coupler components ready to be connected.

As seen in FIG. 1, a golf club 10 includes a large shaft segment 100 with a detachable head 500. Shaft 100 is cut from a standard full-sized shaft to accommodate the shortest club length—usually the putter. Alternatively, shaft segment 100 may be originally manufactured to the desired length, rather than cut from a longer shaft length. Club head 500, intended for mating with shaft segment 100, includes a shorter shaft section 102 between a club shaft insert sheath 504 and a head shaft segment coupler pin 106 (see FIG. 3).

The length of shaft section 100 can vary from club to club and may be used to set the club length optimally for that club. For example, longer clubs such as woods or long irons usually have longer overall shafts than short irons, wedges, and or putters (although some golfers prefer putters having long shaft length). By fixing the length of shaft segment 100, shaft section 102 can be varied to allow for varying shaft lengths desired for the various clubs in a golfers bag. Large shaft segment 100 is fitted to a coupler mechanism 200 via an insert pin 108 (see FIG. 3). Insert pin 108 is pressed and glued into the shaft, but may be affixed by any suitable manner known in the art.

The diameter of pin 108 is selected optimally to fit the internal diameter of the shaft at the shaft length used for the average person, but may also be custom fit to various players' specifications. Modern club shafts are often tapered such that their inner diameter varies along the length of the shaft. Club lengths for players usually vary less than six inches and are typically based on arm length and height of the player, but shaft lengths may be suited to any player's specifications. Because the difference in diameter for a shaft over a six inch section typically is not significant, the diameter of insert pin 108 is set to fit the smallest diameter of shaft 100 in an embodiment of the present invention. This corresponds, for example, to the longest club for the tallest player.

Pin 108 includes a threaded end 108*a* to accept fixed coupler housing 202. This thread is preferably counter-clockwise for right handed players and clockwise for left handed players. The desire for different threading direction based on handedness is due, in part, to the opposing torque/twists generated by left- and right-handed golfers about the shaft. Coupler housing 202 has internal threads to appropriately match the threaded end 108*a* of pin 108. Coupler housing 202 may also be affixed to shaft 100 in other ways known in the art, for example, using expoxy.

Figure 3:
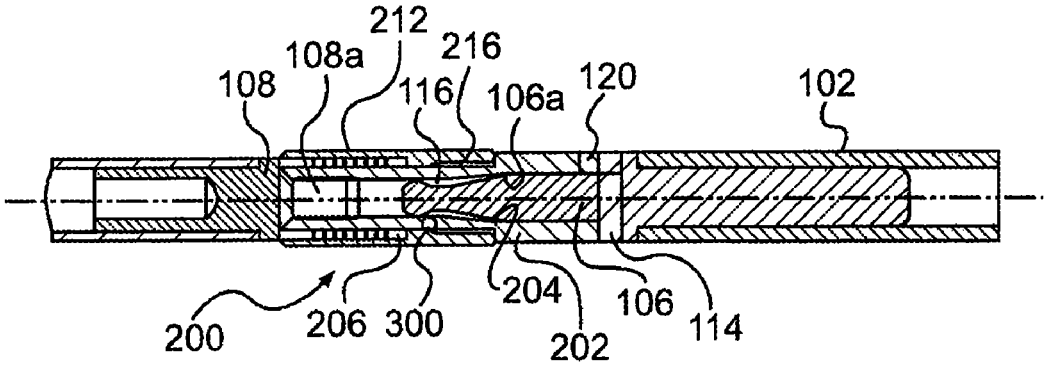
FIG. 3 is a cross sectional view through line of the coupler of FIG. 2.

As seen in FIG. 3, coupler housing 202 has several features. It has a conical portion 204 to mate with matching conical surface 106*a* of the coupler pin 106 affixed to club head 500. It has multiple ball bearing guide holes 206 to hold ball bearings 300 in place. As seen in FIG. 3, only one such guide hole 206 is shown in the cross section, but others may be located about the perimeter. In a preferred embodiment, there are three equally spaced guide holes 206 located about a perimeter of coupler housing 202.

Figure 2:
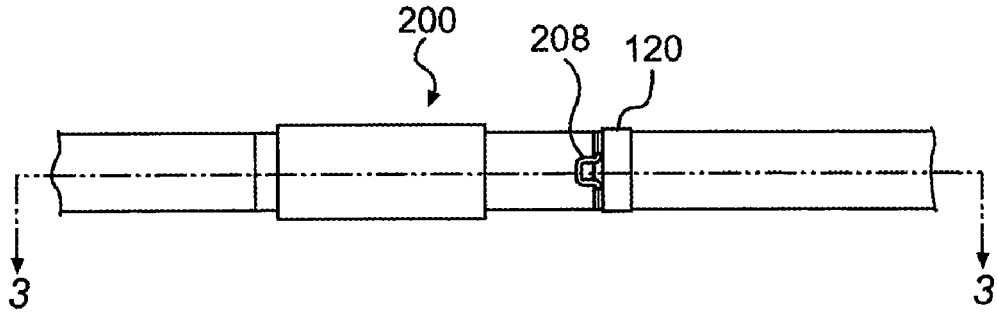
FIG. 2 shows the pull-back sleeve according to an exemplary embodiment of the present invention in isolation.
Figure 4:
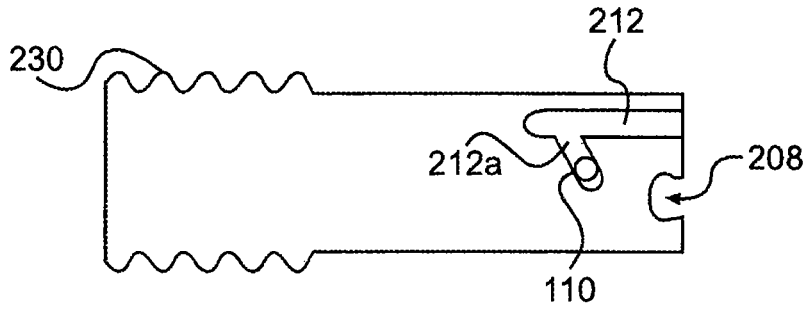
FIG. 4 is a cross-sectional schematic view of a coupler according to an exemplary embodiment of the present invention showing a locking mechanism to limit rotational motion of the club head with respect to the shaft when the head is assembled to the shaft.

As seen in FIGS. 2 and 4, there is a notch 208 to provide a clocking fit to alignment pin 120 in the coupler pin 106. Pin 120 and notch 208 assure the shaft handle always lines up the same way with all club heads. Another pin 110 is press fit into the side of coupler housing 200 to provide clocking into the "L" shaped guide of the pull back sleeve 202.

Head coupling pin 106 is inserted and glued, or otherwise affixed, into the head shaft segments 102 as previously described. These shaft segments 102 vary in length significantly and thus the inside diameter of these shaft segments varies significantly also. In this case, the variation is enough to affect the need for head coupling pins 106 of various diameters. This may or may not be a need in other embodiments since manufacturers may make all parts for a design and simply, standardize on an inner diameter of this part. The design described here relies on modification of readily available club components which have variations.

Figure 5A:
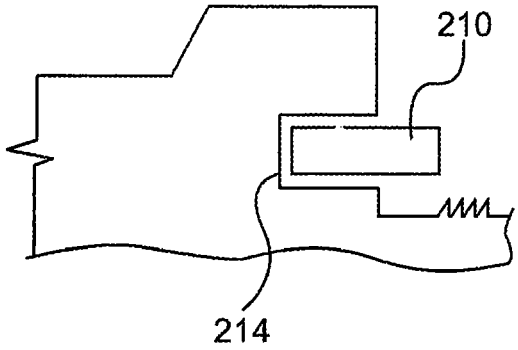
FIGS. 5*a*-5*c* show three views of the shaft coupler insert with pressed in spring pin retainer for the locking mechanism according to a preferred embodiment of the present invention.
Figure 5B:
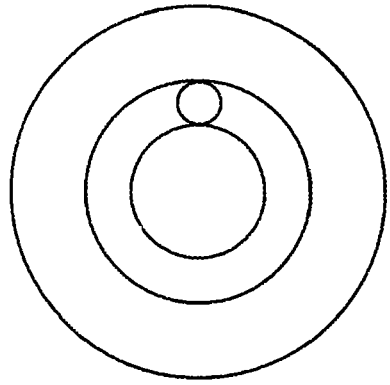
Figure 5C:
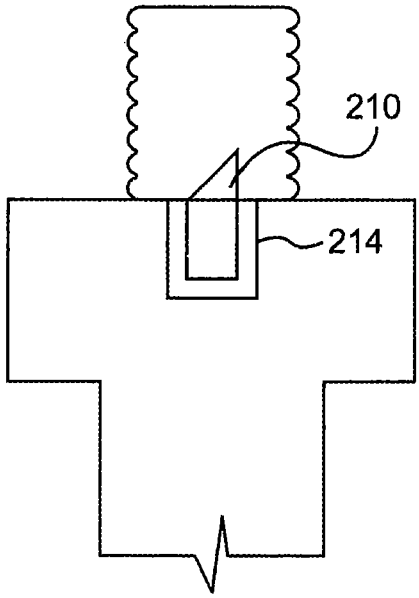
Figure 6:
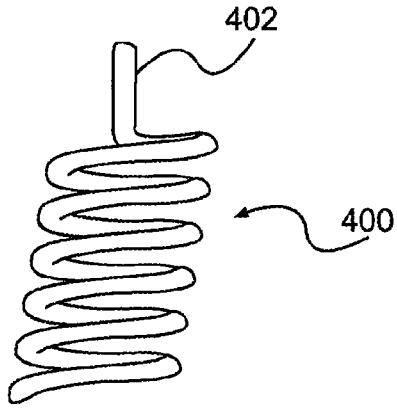
FIG. 6 shows a spring for use inside the coupler.

Housing 200 also includes a press-fit pin 210 to hold a twist to a spring 400 (see FIG. 6). As shown in FIGS. 5*a*-5*c*, pin 210 and hole 212 work together to hold spring 400 in a position of tension to provide a twisting force for the operation of the locking mechanism. Pin 210 wedges the base of the spring 400 and hole 214 receives a short vertical section 402 at the end of spring 400. Spring 400 is twisted to latch during assembly. The twist maintains coupler 200 in locked position at all times. The pull back sleeve 202 must be twisted and pulled back by the golfer in order to pull out the head. When the coupler pin is extracted, pin 110 slides into retaining area 112 to hold it in place until another coupler pin 106 for another head is inserted. This simplifies the hand motions necessary to insert and extract a club while allowing an automatic locking of the coupler.

The head coupling pin 106 has a pressed in pin 120 for locking fit as previously described. Although other kinds of pins can be used, the use of a press fit pin here, and other places in the invention, is preferred as it reduces cost and complexity of manufacture.

The pull back sleeve 202 is the last major component of the coupler 200. Part 202 has a knurled surface 230 which facilitates gripping for hand operation. Although this is shown as a knurled surface, it may be of any surface texture, including being smooth, so long as the sleeve is movable by a user gripping coupler 200 by hand. The sleeve 202 must be pulled and rotated at various times during operation. Part 202 has several surfaces which help make the coupler hold without "play". The conical, or rounded, surface of the end of coupler pin 106 is slowly sloping to allow easy insertion. This rounded end surface presses on the ball bearings 300 during insertion. The ball bearings 300 alternately push on the surface 216 of the pull back sleeve 202. The force of insertion is translated by the angles and rotation of the ball bearings into a motion of the pull back sleeve 202 against spring 400.

During insertion, the operator pulls sleeve 202 toward the shaft using thumb and index finger. This positions the ball bearings 300 free from surface 216 so they can allow passage of the nose of pin 106. When the ball bearings 300 pass over the crest of the nose surface on pin 106 they "fall" into contact with surface 118. When this occurs sleeve 202 can be released coming to rest close to the coupler pin hilt ring 114. In this position the clocking pin 120 is at rest in the notch 208 and the ball bearing 300 is in contact with surfaces 116 and 216.

As sleeve 202 moves in the direction away from club head 500, locking pin 110 becomes clear of notch 112. As this occurs, the twisting force of spring 400 causes sleeve 202 to rotate until pin 110 slides into channel 112*a*. As pin 106 presses further into the coupler 200, sleeve 202 continues to move further away from club head 500. This can be seen as an increasing gap between sleeve 202 and the "hilt" region 114 of coupler pin 106. When the ball bearings 300 pass over the crest of the surface 116 they "fall" into contact with surface 216. As this occurs, sleeve 202 changes direction and comes to rest close to the coupler pin hilt ring 114. In this position, the locking pin 120 is at rest in the notch 208 and the ball bearing 300 is in contact with surfaces 116 and 216.

The angle of surface 116 is steep enough to make a force large enough to enable the ball bearing 300 to "climb" up and thus uncouple. Under static conditions, the force necessary to make this uncoupling occur are well beyond those found in golf club operation. The angle of surface 216 should not be so steep, however, that it cannot be uncoupled by hand when the pull-back sleeve 202 is manipulated by the user. For example, in one embodiment of the present invention angle of surface 216 is approximately 12 degrees.

Testing showed that there is, however, a possibility of vibration assisting this "climb". To account for this possibility, the locking mechanism described above can be employed. However, the locking mechanism is not necessary for the operation or manufacture of a golf club with interchangeable heads according to embodiments of the present invention.

Moreover, other locking mechanisms, for example, the use of a ball bearing for locking pin 110 can be used in embodiments of the present invention to assure adequate locking during operation. The mechanism described here was selected to simplify the manual operation of the coupler.

Figure 7:
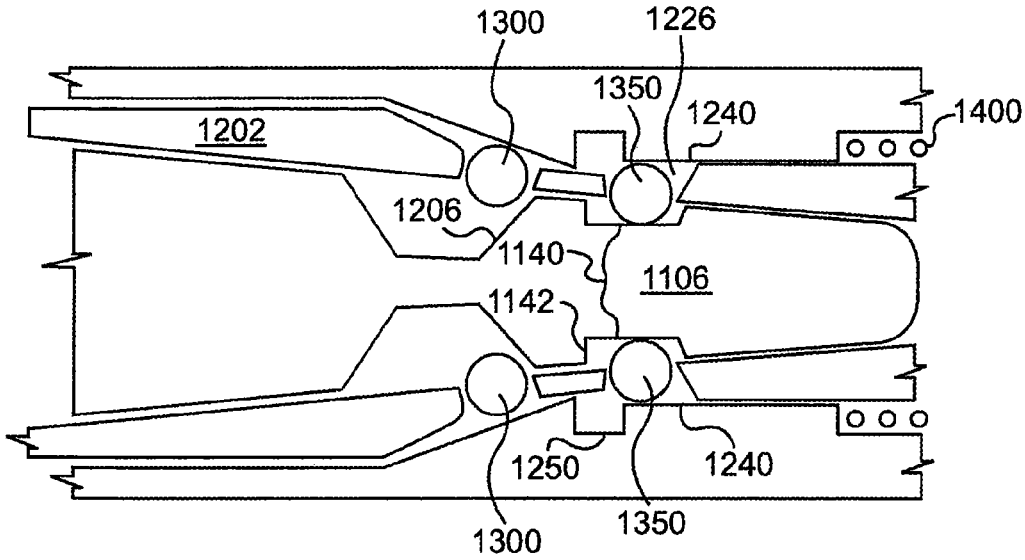
FIG. 7 shows another exemplary embodiment of a coupler having a second set of ball bearing for locking the couple and pin during operation.
Figure 8:
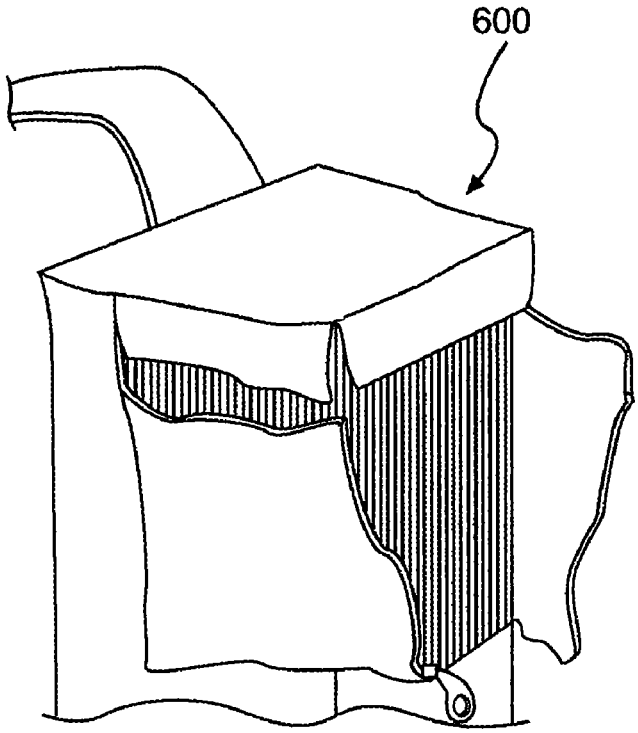
FIG. 8 shows a partial prospective view of a carrying bag according to an exemplary embodiment of the present invention.
Figure 10:
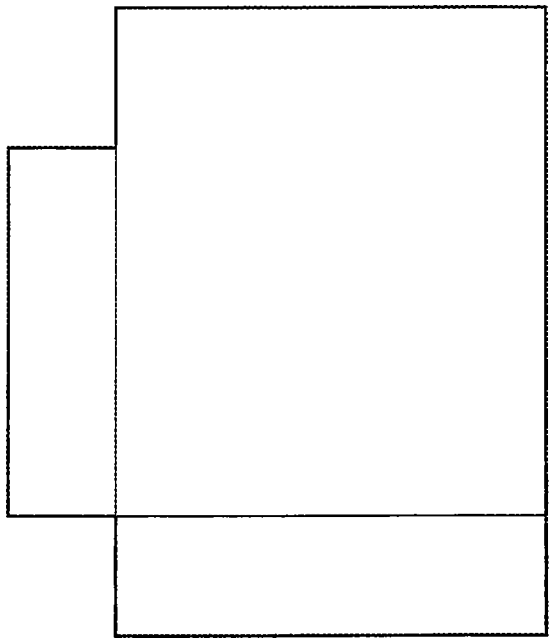
FIG. 10 shows the top of the bag of FIG. 8.
Figure 9C:
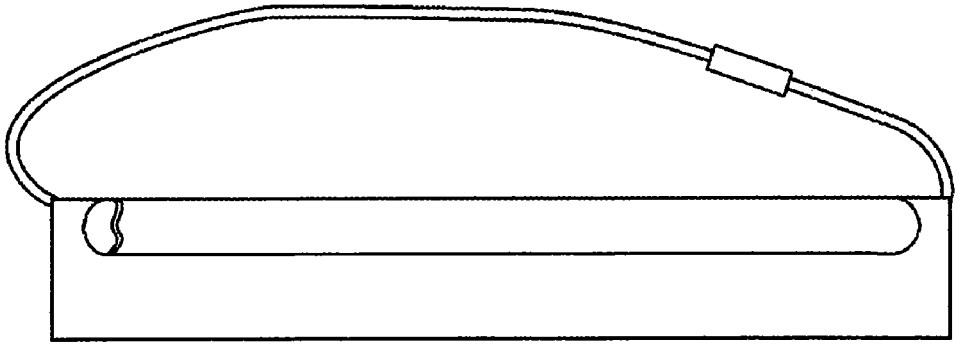
FIGS. 9*a*-9*c* shows front and side elevation views of the bag of FIG. 8.
Figure 9B:
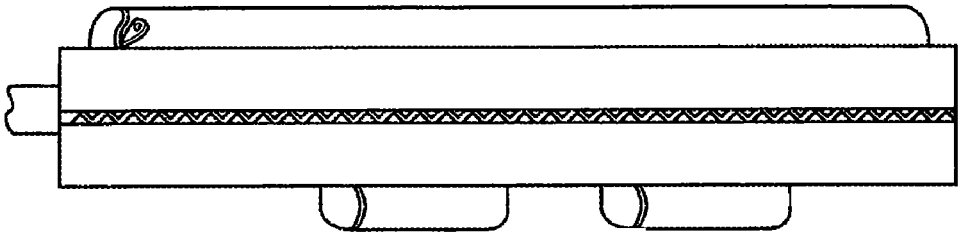
Figure 9A:
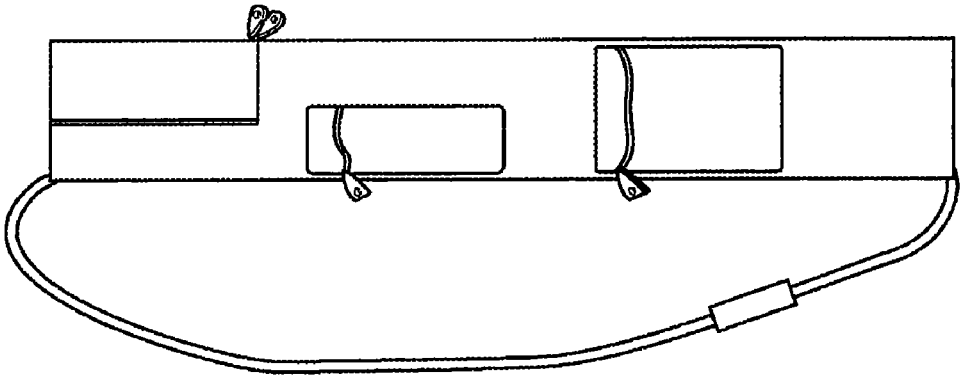

FIG. 7 shows coupler 1200 with pin 1106 inserted and held in place by ball bearings 1300 and locked by bearings 1350. Bearings 1350 are held in coupler 1202 by holes 1226. There are three bearings 1350 oriented 120 degrees apart (similar bearings 1300). When these bearings are between surfaces 1140 of pin 106 and surfaces 1240 of the pull back sleeve 1202, the coupler 1200 will be locked and can only be released by manual operation. To visualize this, one can imagine ball bearings 1300 climbing surface 1206 and thus causing pull back sleeve 1202 to move towards the shaft 100 (not shown in FIG. 7). This would allow pin 1106 to begin to uncouple. Ball bearings 1350 will then wedge against surface 1142, which is perpendicular to this direction of motion. The combination of surfaces 1140, 1142, and 1240 form a sort of box, which is filled by ball bearing 1350, thus preventing uncoupling.

Manual uncoupling is possible because the operator moves the pull back sleeve 1202 against spring 1400, positioning surface 1250 at ball bearing 1350. In this position, the ball bearings 1350 can move out of the way of the coupling pin 1106 and extraction can occur. Insertion is done in an analogous, but reverse manner.

Such a golf club system would not necessarily be suitable for use with present golf bags, which are designed to carry multiple clubs, each with its own shaft. Accordingly, a new bag design would be desirable for carrying the various heads and shaft(s). Such a bag according to an embodiment of the present invention is shown in FIGS. 8 through 11. The size and weight of the bag are considerably less than standard golf bags.

While bag design may vary considerably, any bag carrying such a system preferably has components and shape roughly as shown in bag 600. The height of the bag can be less than a conventional golf bag because the length of the shaft 100 sets the height. In a conventional golf bag the longest club (the driver, or one wood, for instance) will set the overall height of the bag. In an embodiment of the invention the height of bag 600 was 36 inches in height—a full 14 inches less than what a bag using standard clubs would be. The width and depth of the bag are also considerably less than a conventional bag since the heads can be stacked for a close fit in the bag.

Figure 11:
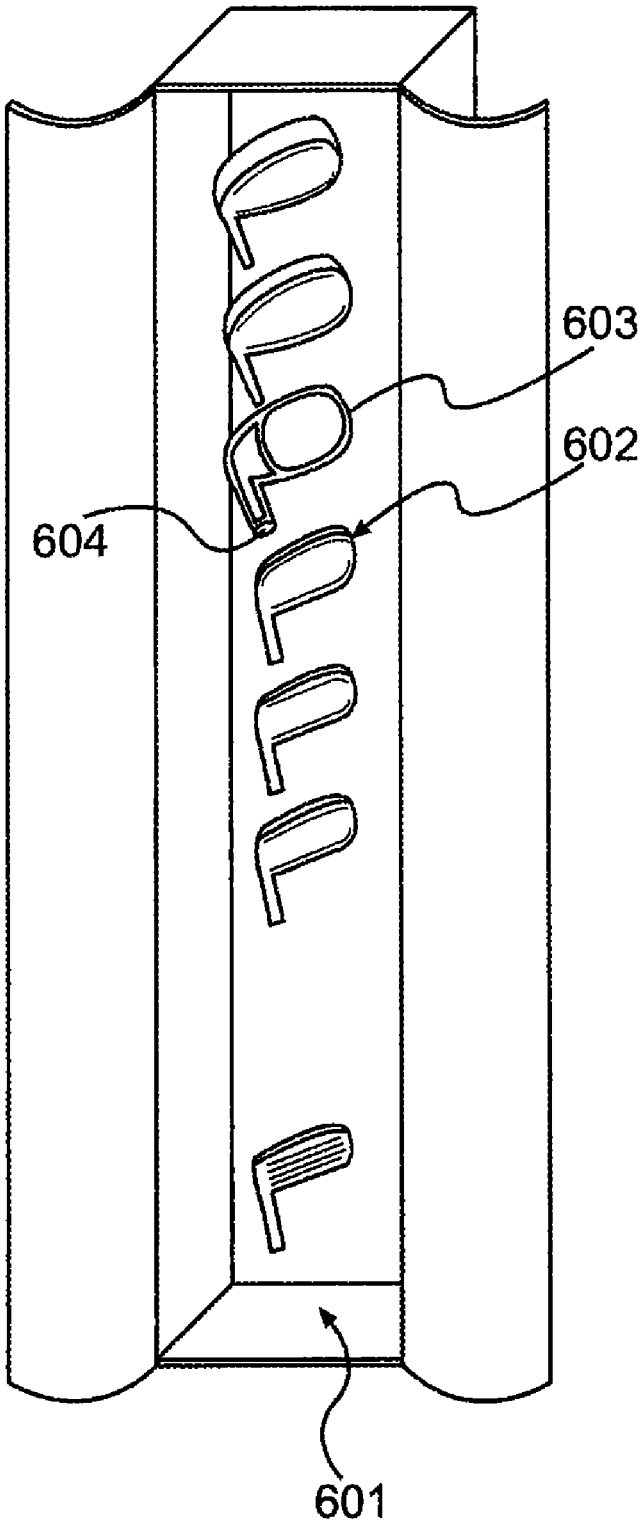
FIG. 11 shows an open view of the bag of FIG. 8 having cut foam for insertion of club heads.

FIG. 11 shows an example of how these heads 602 may be stored in such a bag. In this example, the bag 600 is filled with foam 601. Recessed areas 603 are cut in foam 601 for club heads and holes 604 are drilled for shaft segments 102 attached to coupling pins 106. Other materials may be used to contain the clubs as well as other physical orientations selected to optimize space reduction or ease of club access. Another orientation of clubs in the bag could leave the club heads in the foam with the coupling pin end 106 exposed. This orientation would allow the user to press the shaft coupler 202 onto the coupler pin 106 to perform the coupling while the head is held by the bag. The assembled club would then be extracted by the user.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A golf club having a detachable head, comprising:

a first shaft segment and a second shaft segment, the first shaft segment having a grip or handle attached thereto and the second shaft segment being fixedly attached to a golf club head, wherein one of the first shaft segment and the second shaft segment has an insertion pin having a conical insertion section, the conical insertion section having a top and a base, the base having a radius greater than a radius of the top such that the length of the conical insertion section from the base to the top is greater than the radius of the base of the conical insertion section and the other of the first shaft and the second shaft has a receptor pin having a conical receptor section; and a coupler affixed to either the first shaft segment or the second shaft segment for reversibly mating the handle to the club head, wherein the coupler comprises a pull-back sleeve movable with respect to the conical receptor section to allow for movement of one or more first ball bearings within the couple such that in a first pull-back sleeve position, the ball bearings allow insertion of an insertion pin during mating of the first and second shaft segments, and in a second pull-back sleeve position, the ball bearings exert a force on the conical insertion section to tightly couple the first shaft segment to the second shaft segment.

2. The golf club of claim 1, further comprising an alignment pin to ensure a proper rotational alignment of the first and second shaft segments when the two shaft segments are mated within the coupler.

3. The golf club of claim 2, further comprising a spring within the coupler.

4. The golf club of claim 3, wherein the spring provides a rotational spring force for the pull-back sleeve.

5. The golf club of claim 3, wherein the spring provides an axial spring force for the pull-back sleeve.

6. The golf club of claim 1, further comprising one or more second ball bearings for locking the insertion pin in place when the two shaft segments are mated within the coupler.

7. The golf club of claim 1, wherein the coupler is fixedly attached to the first shaft segment and the insertion pin is fixedly attached to the second shaft segment.

8. A golf club set, comprising one or more golf clubs of claim 7 and a plurality of golf club heads, each golf club head attached to the second shaft segment, wherein at least two of the shaft segments have different lengths.

9. A golf club, comprising:

a first shaft segment, coupled to a handle end of the golf club, the first shaft segment having a fixed length based on a shortest club shaft length in a set of clubs; and a second shaft segment coupled to a club head end of the golf club, the second shaft having a length dependent on a type of club head to which it is attached; and a coupler for coupling the first shaft segment to the second shaft segment, the coupler comprising:

a coupling sleeve;

a first pin adapted to fit in the first shaft segment; and a second pin adapted to fit in the second shaft segment such that the first and second pins can be removably mated to provide a secure coupling of the first and second shaft segments, wherein the coupler causes a force on the first and second pins to tightly couple the first shaft segment to the second shaft segment;

a first set of ball bearings that causes a force to be exerted on the first and second pins to tightly couple the first shaft segment to the second shaft segment, wherein the coupling sleeve can be moved to a position to allow the ball bearings to release the tight coupling of the first and second shaft segments; and a second set of ball bearings, wherein the coupling sleeve is moved to allow each ball bearing in the second set of ball bearings to fall into a notch.

10. A golf club, comprising:

a first shaft segment, coupled to a handle end of the golf club, the first shaft segment having a fixed length based on a shortest club shaft length in a set of clubs;

a second shaft segment coupled to a club head end of the golf club, the second shaft segment having a length dependent on a type of club head to which it is attached; and a coupler for coupling the first shaft segment to the second shaft segment, the coupler comprising:

a coupling sleeve;

a first pin adapted to fit in the first shaft segment; and a second pin adapted to fit in the second shaft segment such that the first and second pins can be removably mated to provide a secure coupling of the first and second shaft segments, wherein the coupler causes a force on the first and second pins to tightly couple the first shaft segment to the second shaft segment; and a set of ball bearings that causes a force to be exerted on the first and second pins to tightly couple the first shaft segment to the second shaft segment, wherein one of the first pin and second pin has a conical insertion section and the other of the first pin and the second pin has a conical receptor section such that the insertion section is inserted into the receptor section.

* * * * *